United States Patent [19]

Sansevero

[11] Patent Number: 4,930,622

[45] Date of Patent: Jun. 5, 1990

[54] CURVED ESCALATOR WITH FIXED CENTER CONSTANT RADIUS PATH OF TRAVEL

[75] Inventor: Frank M. Sansevero, West Hartford, Conn.

[73] Assignee: Otis Elevator Company, Farmington, Conn.

[21] Appl. No.: 328,926

[22] Filed: Mar. 27, 1989

[51] Int. Cl.[5] ..... B66B 21/02

[52] U.S. Cl. ..... 198/328; 198/334; 198/778

[58] Field of Search ..... 198/328, 334, 778, 831, 198/845

[56] References Cited

U.S. PATENT DOCUMENTS

| | | | |
|---|---|---|---|
| 617,779 | 1/1899 | Seeburger . | |
| 685,019 | 10/1901 | Venn . | |
| 723,325 | 3/1903 | Souder . | |
| 727,720 | 5/1903 | Venn . | |
| 782,009 | 2/1905 | Dodge . | |
| 967,710 | 8/1910 | Bennett . | |
| 984,495 | 2/1911 | Seeberger . | |
| 984,858 | 2/1911 | Seeberger . | |
| 999,885 | 8/1911 | Seeberger . | |
| 1,023,443 | 4/1912 | Seeberger . | |
| 2,695,094 | 11/1954 | Riley . | |
| 2,823,785 | 2/1958 | Hefti . | |
| 3,878,931 | 4/1975 | Luna . | |
| 4,662,502 | 5/1987 | Nakatami | 198/328 |
| 4,726,460 | 2/1988 | Otomo | 198/328 |
| 4,730,717 | 3/1988 | Sugita | 198/328 |
| 4,739,870 | 4/1988 | Saito | 198/328 |
| 4,746,000 | 5/1988 | Nakatami et al. | 198/328 |

FOREIGN PATENT DOCUMENTS

| | | |
|---|---|---|
| 3441845A1 | 6/1985 | Fed. Rep. of Germany . |
| 48-25559 | 7/1973 | Japan . |
| 58-220077 | 12/1983 | Japan . |
| 292641 | 6/1928 | United Kingdom . |

*Primary Examiner*—Robert J. Spar
*Assistant Examiner*—D. Glenn Dayoan
*Attorney, Agent, or Firm*—William W. Jones

[57] ABSTRACT

An escalator is provided with a curved path of travel from its entry to its exit landings. The path of travel of the escalator steps as seen in plan is a curve having a fixed center and a constant radius from landing to landing. In elevation, each landing portion will be disposed in vertically spaced horizontal planes, and there with be a medial constant slope ascending or descending portion. Interconnecting each landing portion with the constant slope portion will be entry and exit transitional curved portions of varying slope as seen in the elevational view. To enable the steps to traverse the curved path successfully, the effective length of the outer of the step chains is varied at different points along the path of travel of the escalator.

11 Claims, 7 Drawing Sheets

CURVED ESCALATOR WITH FIXED CENTER CONSTANT RADIUS PATH OF TRAVEL

DESCRIPTION

1. Technical Field

This invention relates to a curved escalator construction, and more particularly to a curved escalator having a path of travel defined by a fixed center, constant radius arc when viewed in plan.

2. Background Art

Escalators which follow a curved path of travel from entry landing to exit landing are generally known in the prior art. There are two general approaches which have been taken in the prior art to designing an operable curved escalator. One approach involves the use of a path of travel which, in plan, is defined by an arc having varying radii of curvature and emanating from a shifting center. The other approach involves the use of a path of travel which, in plan, is defined by an arc of constant radius struck from a fixed center.

Patent publications which relate to the aforesaid first approach include: Japanese Patent Publication 48-25559 of July, 1973; German Patent Publication 3,441,845, June 13, 1985; U.S. Pat. No. 4,662,502, Nakatani et al, granted May 5, 1987; and U.S. Pat. No. 4,746,000, Nakatani et al, granted May 24, 1988.

Patent publications which relate to the aforesaid second approach include: U.S. Pat. Nos. 685,019, Oct. 22, 1901; 723,325, Mar. 24, 1903; 727,720, May 12, 1903; 782,009, Feb. 7, 1905; 967,710, Aug. 16, 1910; 2,695,094, Nov. 23, 1954; 2,823,785, Feb. 18, 1958; 3,878,931, Apr. 22, 1975; 4,726,460, Feb. 23, 1988; 4,730,717, Mar. 15, 1988; 4,739,870, Apr. 26, 1988; British Pat. No. 292,641, June 22, 1928; and Japanese Patent Disclosure No. 58-220077, 1983.

Japanese Patent Disclosure No. 58-220077, dated Dec. 21, 1983 discloses a curved escalator which has a constant radius, fixed center arcuate path of travel when viewed in plan. When the treads of the escalator move from the horizontal landing to the constant slope intermediate zone, they are properly repositioned by accelerating and decelerating their inside edges in the transition zones adjacent the landings. The differential movement of the inside tread edge is accomplished with pivoting links which interconnect the step axles of adjacent steps and which are joined at pivot points provided with rollers that traverse a track. The step axles also have rollers at their inside ends which travel over another track vertically spaced from the link roller track. The position of the inside edges of the steps is varied in the transition zone by varying the vertical distance between the inside step axle roller track and the link roller track beneath it. The links lengthen in the constant slope portion of the escalator and shorten in the horizontal landing and turn around zones. The steps are engaged by driving chains which connect to the step axles only in the constant slope zone where the position of the steps relative to each other remains constant. The drive chains do not contact the step axles in the transition, landing, or turn around zones. Varying the position of the inside edge of the steps requires that the connecting links be shortened in the horizontal and turn around zones of the escalator, and the use of two separate tracks for the inside step axle roller and for the adjustment link rollers, requires that the adjustment links will always be skew throughout the entire path of travel of the escalator. The use of two separate axle roller and link roller tracks also requires that the drive housing and tread reverse sprockets be vertically elongated.

Charles D. Seeberger was a turn-of-the-century inventor who obtained U.S. Pat. Nos. 617,778, granted Jan. 17, 1899; 617,779,granted Jan. 17, 1899; 984,495, granted Feb. 14, 1911; 984,858, granted Feb. 21, 1911; and 999,885, granted Aug. 8, 1911, which all relate to curved escalators. The 617,779 patent discusses the need to shorten and lengthen step chains in a curved escalator having a path of travel which has portions with different radii. The step chains are formed with segments which are threadedly connected to each other. The segments are rotated by a pinion mechanism to unscrew, or tighten the threaded connections whereby the chain is lengthened or shortened when necessary. The 984,495 patent states that a curved escalator with a fixed radius, constant center cannot have both ends of adjacent step axles connected to each other by links of fixed length. A scissor connection is then made between succeeding axles, and a slight adjustment of this connection is made when the steps move from the curved horizontal track section to the inclined curved section of the track. The adjustment is described at Page 3, line 119 to Page 4, line 28 of the patent. The 999,885 patent describes a curved escalator having its steps connected together at their inner and outer edges, with the outer edge connection being of constant length, and the inner edge connection being variable by reason of adjustable links.

DISCLOSURE OF INVENTION

This invention relates to a step chain and track assembly for use in a curved or spiral escalator of the type having a fixed center, constant radius arcuate path of travel when viewed in plan. The assembly of this invention takes into account that in the escalator of the type specified, the steps, as they pass from the horizontal landing entry area into and through the entry transitional area to the constant slope area, will have to pivot with respect to each other in order to have their tread surfaces remain horizontal. This pivoting movement is accomplished by moving the outer side of the steps at a different angular velocity than the inner side of the steps as the latter move through the entry transition zone and through the constant slope zone when viewed in plan. In the exit transition zone, the differential movement of the inner and outer sides of the steps is reversed so that the steps then pivot back to their original orientation relative to each other. Thus the velocities of the steps and their angular positions will vary at different locations along the path of movement thereof. In order to allow the pivotal step movement without binding the steps together, the step risers will be formed with a modified conical configuration, the details or specifics of which will be determined by the radius of curvature of the path of travel of the escalator, and the size of the step.

The differential velocity and pivotal movement of the steps is accomplished in the assembly of this invention preferably by changing the effective length of the outer step chain without changing the length of its individual links. It should be noted that the actual length of the step chain is not altered, but only its effective length is changed. The step chains consist of a plurality of links which are pivotably connected together and which are also connected to the roller axles on the steps. Each of the chain link pivot connections carries a chain roller, as will be described in greater detail hereinafter. The step roller axles carry rotating rollers which move on tracks mounted beneath the steps, in a known manner. In the assembly of this invention, the outermost of the tracks along which the step rollers move is a compound track, which in the constant slope portion of the escalator path consists of only one common track along which all of the chain rollers, including the step axle rollers, move. In the constant slope portion of the escalator path, the outer step chain will have a first effective length, and thus the adjacent step axles will be separated by a first shortened predetermined distance. In the horizontal and turn around portions of the escalator path, the track has two vertically separated components, and the step axle chain rollers move along one of the components, while the intermediate chain link rollers move along the other track component. The vertical displacement of the step axle rollers from the common track portion to the separated track portion causes the effective length of the chain to increase on the separated track portions. Thus the distance between the step axles will be larger in the separated track portions. Between the two track portions, are transitional zones where the track portions gradually change from the separated condition to the common condition, and return. The rate of change between the two track conditions determines the rate of change of the effective chain length, and thus the rate of change of the step velocity. In accordance with this invention, in the entry transitional zone, i.e., the transitional zone between the entry landing and the constant slope portion of the escalator, the effective length of the outside chain will shorten, and the reverse will happen in the exit transitional zone which connects the constant slope portion of the escalator with the exit landing.

It is therefore an object of this invention to provide an escalator-driving step chain and track assembly for use in a curved escalator having a fixed center and constant radius path of travel when viewed in plan.

It is an additional object of this invention to provide an assembly of the character described wherein the steps of the escalator are pivoted with respect to each other as the steps move to or from horizontal landing zones from or to a constant slope intermediate zone.

It is a further object of this invention to provide an assembly of the character described wherein the pivotal movement of the steps is accompanied by a change in the angular velocity of the outer edges of the steps when viewed in plan.

It is another object of this invention to provide an assembly of the character described wherein the effective length of the outer step chain is changed as the steps move between landing zones and the intermediate constant slope zone so as to change the distance between step axles on adjacent steps on the escalator.

It is yet an additional object of this invention to provide an assembly of the character described wherein the effective length of the step chain is changed by selectively kinking the chain.

These and other objects and advantages of the invention will become more readily apparent from the following detailed description of the invention when taken in conjunction with the accompanying drawings in which:

BEST MODE FOR CARRYING OUT THE INVENTION

Figure 1:
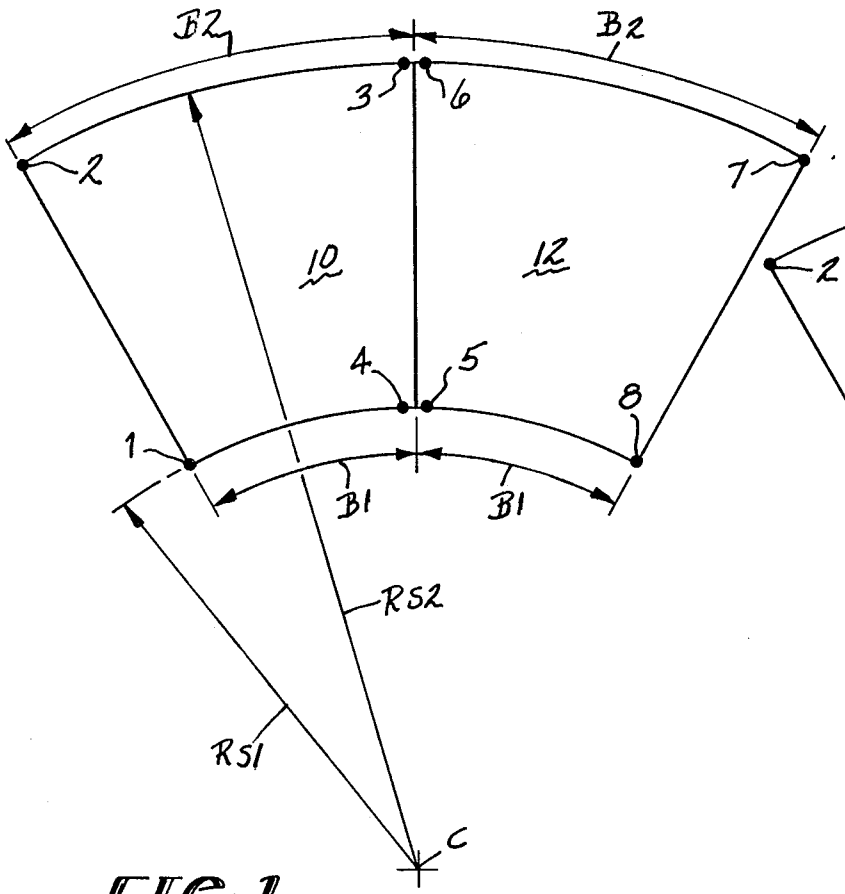
FIG. 1 is a plan view of the steps of the escalator as they appear in the horizontal landing zones of the escalator.

Referring now to FIG. 1, there are shown two steps 10 and 12 on the escalator as they would appear in plan view looking down on the treads in one of the horizontal landing zones. The steps 10, and 12 have constant arcuate inner sides of radius RS1 along which points 1, 4, 5 and 8 lie, and constant arcuate outer sides of radius RS2 along which points 2, 3, 6 and 7 lie. The radii RS1 and RS2 are struck from a fixed center C. The inner step chain has an incremental length B1 for each step 10 and 12, and the outer step chain has an incremental length B2 for each step 10 and 12.

Figure 2:
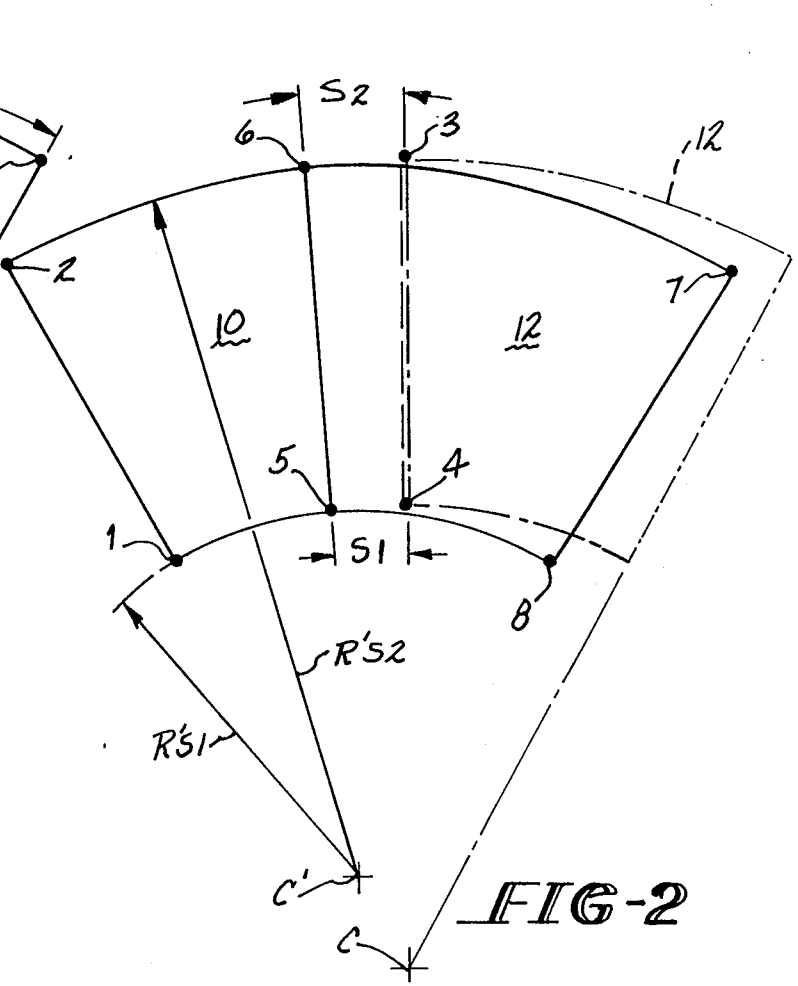
FIG. 2 is a plan view similar to FIG. 1 but showing the pivotal movement that the steps would undergo in the constant slope intermediate zone if the inner and outer step chains were kept at a constant effective length.

Referring to FIG. 2, the positions of the steps 10 and 12 are illustrated as they would appear in the intermediate constant slope incline zone of the escalator if the effective incremental lengths B1 and B2 of the inner and outer step chains were kept constant. The position of the step 12 in the landings is shown in FIG. 2 in phantom and the position of the step 12 in the incline is shown in solid lines. When the steps 10 and 12 are in the inclined zone of the escalator, assuming that step 12 is the higher step, it will have pivoted up and over the step 10 so that point 6 will have moved a distance S2 and point 5 will have moved a distance S1. This movement of the step 12 will cause the apparent radius of the inner side sections of the steps 10 and 12 15 to decrease to R'S1 and the apparent radius of the outer side sections of the steps 10 and 12 to decrease to R'S2 both of which will be struck from a center point C' which is offset from the original center point C.

Figure 3:
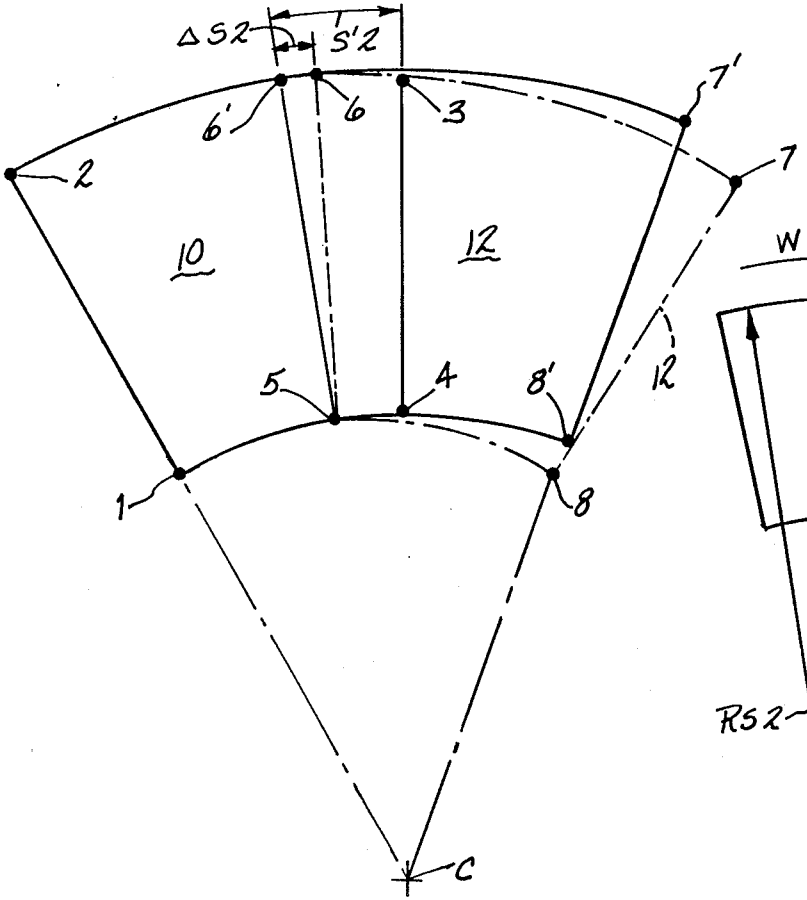
FIG. 3 is a plan view similar to FIG. 2, but showing the pivoted position of the steps in the intermediate zone when the effective length of the outside step chain is shortened while maintaining constant the effective length of the inside step chain.
Figure 7:
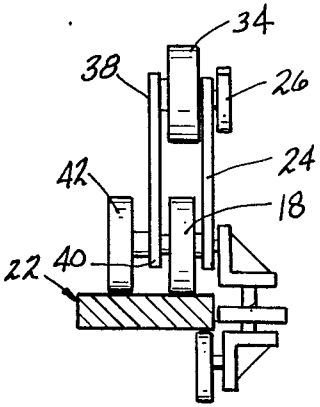
FIG. 7 is a sectional view of the assembly of FIG. 6 showing the manner of mounting side and upthrust rollers thereon.

In order to counter this tendency of the steps 10 and 12 to spiral into a tighter radius path of travel, and to maintain the original radial path of travel, the step 12 must be pivoted an additional increment over the step 10 when the steps are in the intermediate inclined zone of the escalator path. In FIG. 3, the position of step 12 from FIG. 2 is shown in phantom, and the desired position needed t provide the constant radius is shown in solid lines. To achieve the desired position, the outside of the step 12 is further pivoted a distance ΔS2 so that the corners 6, 7 and 8 of the step 12 shift to positions 6', 7' and 8' respectively. The corner 5 of the step 12 can be considered as forming the pivot point and thus does not substantially shift its position. It will be appreciated that the radii described above are actually the step chain radii, but for purposes of explaining the step movement, they can be considered to be the radii of the path of movement of the inner and outer edges of the steps.

As noted, to make a constant plan radius curved escalator, the distance between point 2 and point 6 needs to get smaller while maintaining the distance between point 1 and point 5. A pivoting motion about point 5 is the result. This is done by shortening the length of the outer step chain as it goes through the entry transition zone. The result thereof is shown in FIG. 3.

The following equations can be used to calculate the required shortening of the outer step chain:

$$S1 = B1\,(1 - \cos\alpha\, s1) \qquad \text{eq. 1}$$

$$S2 = B2\,(1 - \cos\alpha\, s2) \qquad \text{eq. 2}$$

$$S'2 = \frac{Rs2}{RS1}\,(S1) \qquad \text{eq. 3}$$

$$\Delta S2 = S'2 - S2 \qquad \text{eq. 4}$$

$$B'2 = \frac{B2\cos\alpha\, s2 - \Delta S2}{\cos\alpha\, s2} \qquad \text{eq. 5}$$

where

Rs1=plan radius inner step track;
Rs2=plan radius outer step track;
B1=incremental chain length inner step;
B2=incremental chain length outer step;
B'2=incremental chain length outer in transition/incline section;
α s1=angle of inclination inner step track;
α s2=angle of inclination outer step track;
S1=arc length projection inner step;
S2=arc length projection outer step;
S'2=arc length projection outer step which will pivot the step onto the constant radius; and
ΔS2=delta arc length projection outer step which will pivot the step onto the constant radius.

VELOCITY

Figure 5:
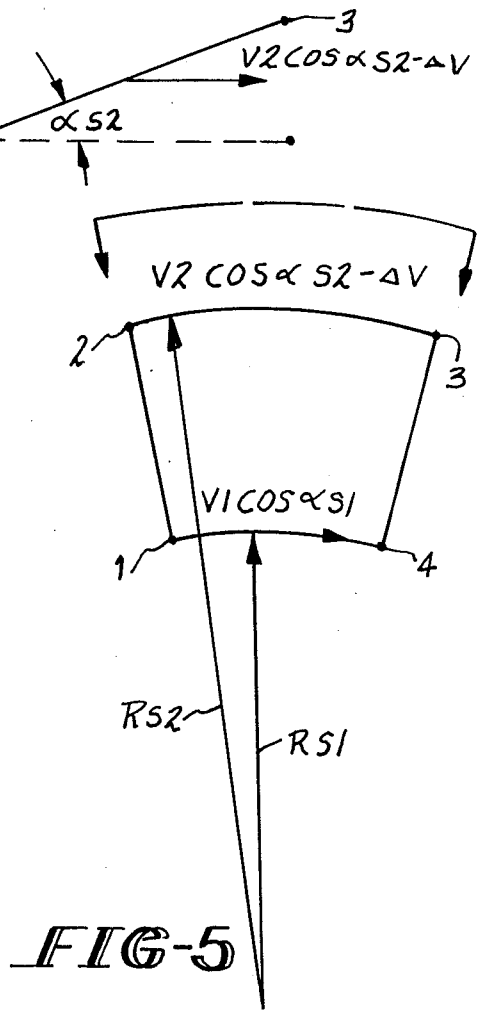
FIGS. 4 and 5 are schematic views of the steps in the landing and inclined portions respectively showing how velocities can be related to step positions.
Figure 4:
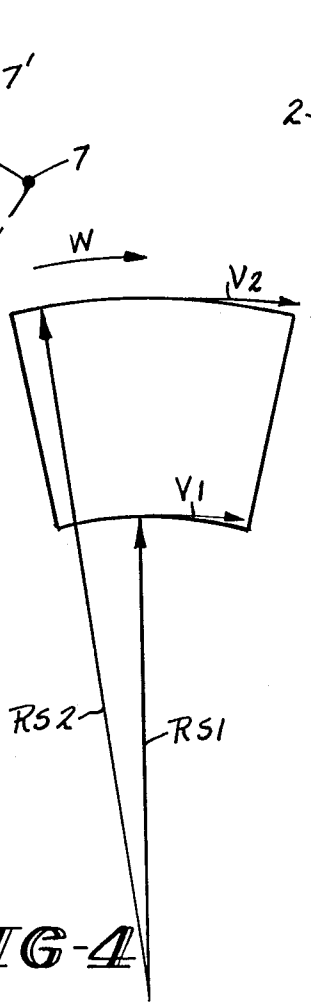

The following equations show how the velocities will be related to the step positions as shown in FIGS. 4 and 5, wherein:

V1=tangential velocity inner step edge;
V2=tangential velocity outer step edge;
W=angular velocity;
Rs1=plan radius inner step track;
Rs2=plan radius outer step track;
αs1=angle of inclination inner step track;
αs2=angle of inclination outer step track;
B1=incremental chain length inner step;
B2=incremental chain length outer step;
ΔS2=delta arc length projection outer step which will pivot the step onto the constant radius; and
ΔV=delta velocity subtracted from outer step in the plan view.

For the horizontal section which is shown in FIG. 4, the following equations apply.

$$V1 = W \times Rs1$$

$$V2 = W \times Rs2$$

$$\frac{V1}{V2} = \frac{Rs1}{Rs2} = \text{constant} = K$$

$$\frac{Rs1}{Rs2} = \frac{B1}{B2}$$

For the transition section and incline section which is shown in FIG. 5, the following equations apply.

$$\frac{V1\cos\alpha\, s1}{V2\cos\alpha\, s2} \neq \frac{Rs1}{Rs2} = K$$

$$\frac{B1\cos\alpha\, s1}{B2\cos\alpha\, s2} \neq \frac{Rs1}{Rs2} = K$$

To vary the velocity of the outside step edge and vary the outside axle distance the following equations apply.

$$\frac{V1\cos\alpha\, s1}{V2\cos\alpha\, s2 - \Delta V} = \frac{Rs1}{Rs2} = \frac{B1\cos\alpha\, s1}{B2\cos\alpha\, s2} - \Delta S2$$

whereupon ΔV can be calculated as follows:

$$\Delta V = V2\cos\alpha\, s2 - \frac{Rs2}{Rs1}\,(V1\cos\alpha\, s1).$$

Figure 6:
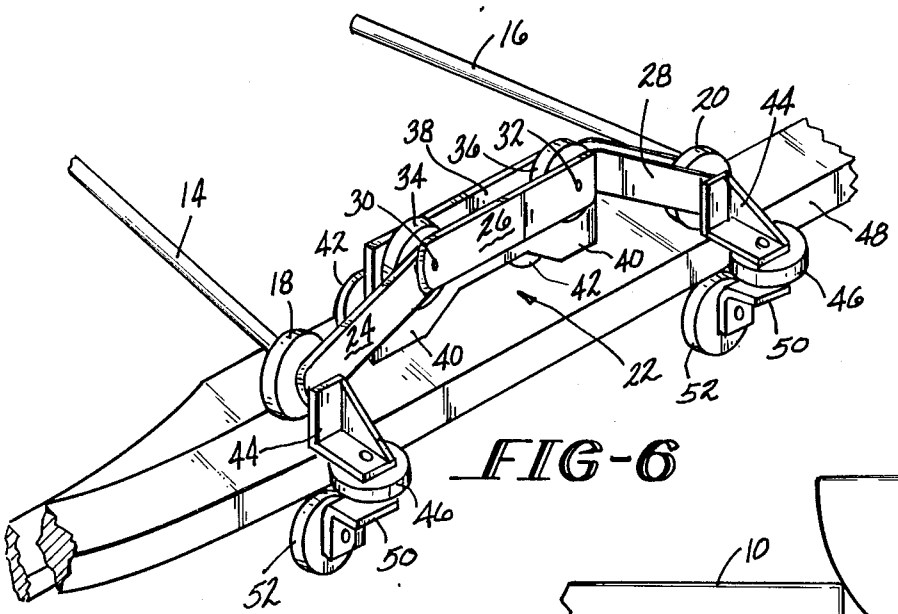
FIG. 6 is a perspective fragmented view of a first embodiment of a step chain and track assembly formed in accordance with this invention.
Figure 8:
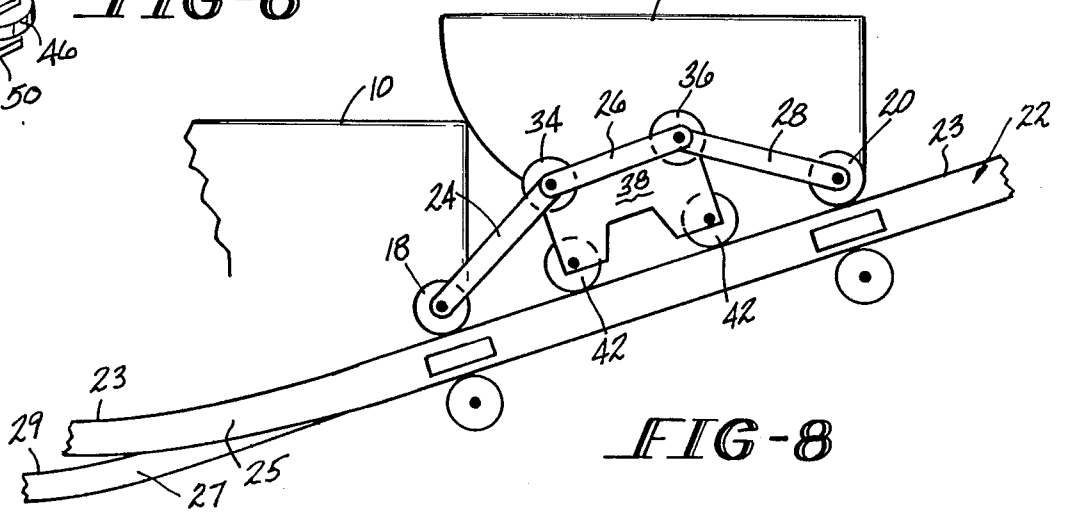
FIG. 8 is a side elevational view showing the assembly on the intermediate constant slope zone of the track illustrating how the effective length of the step chain is shortened.
Figure 9:
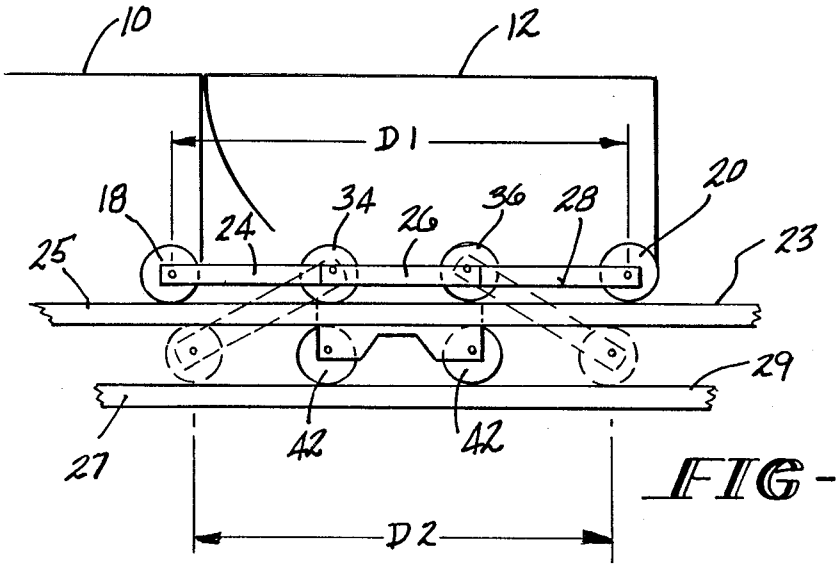
FIG. 9 is a side elevational view showing the assembly on a horizontal landing zone of the track illustrating how the effective length of the step chain is increased.

Referring now to FIGS. 6–10, there is shown a first embodiment of a step chain and track assembly which is operable to effect the aforesaid changes in the effective length of the outer step chain, and in the velocity of the outer side of the steps 10 and 12, which are shown schematically in FIGS. 8 and 9. In FIG. 6 the step chain is shown as it appears on the intermediate constant slope portion of the escalator. What is shown is one segment of the step chain that interconnects adjacent step axles 14 and 16. The step axle 14 is mounted on the step 10 and the axle 16 is mounted on the step 12. The step axles 14 and 16 carry rollers 18 and 20 respectively which roll along the track 22. The chain segment shown includes three links 24, 26 and 28 which are pivotally connected to the step axles 14 and 16 respectively, and are also connected to rotation axles 30 and 32 of a pair of intermediate chain rollers 34 and 36. The intermediate chain roller axles 30 and 32 are also pivotally journaled to opposite ends of the chain link 26. A camming bracket 38 is transversed spaced from the chain link 26 and carries the opposite ends of the intermediate chain roller axles 30 and 32. The camming bracket 38 extends toward the track 22 downwardly from the chain link 26, and includes spaced feet 40 on which camming rollers 42 are journaled. The camming rollers 42 move along the track 22 along a path transversely offset from the path that the axle rollers 18 and 20 move along. Brackets 44 are mounted on the links 24 and 28 and carry side thrust rollers 46 which engage the outside edge 48 of the track 22 to provide resistance to the tendency of the steps to move inwardly along the path of travel of the escalator. Additional brackets 50 interconnect the side thrust rollers 46 with upthrust rollers 52 which engage the underneath surface of the track 22 and which also resist the tendency of the chain to rise vertically in the transitional and constant slope zones of the escalator.

As shown in FIGS. 6 and 8, the chain segment interconnecting steps 10 and 12 is positioned on the constant slope inclined intermediate zone of the track 22 wherein the step axle rollers 18 and 20 and the camming rollers 42 on the camming bracket 38 engage transversely offset portions of the top surface 23 of the track 22 which are coplanar. This causes the intermediate chain rollers 34 and 36 to be elevated above the track surface 23, and causes the chain links 24 and 28 to be downwardly inclined from opposite ends of the chain link 26, which in turn creates a kink in the chain and shortens the effective length of the chain segment. In the transition zones, the track 22 is formed with two separated branches 25 and 27, the uppermost 25 of which continues the chain link roller engaging surface 23 of the track 22. The lower branch 27 of the track 22 lies transversely adjacent to the upper branch 25 along the path that the cam rollers 42 follow. In the transition zone, the vertical offset between the roller path surfaces 23 and 29 progressively increases as the slope angle of the track decreases, until the latter equals zero, where the track enters the horizontal landing zone, shown in FIG. 9. In this zone the step axle rollers 18 and 20 and the chain link rollers 34 and 36 are all disposed on the upper branch 25 of the track 22, and the links 24, 26 and 28 are all aligned. The cam rollers 42 are on the lower branch 27 of the track 22, and the treads of the steps 10 and 12 are coplanar. Thus, as the step chain passes from the constant slope zone of the track shown in FIG. 8 to the horizontal landing zone shown in FIG. 9, the distance between adjacent step axles 14 and 16 increases from $D_2$ to $D_1$. This increase is caused by straightening the kink in the step chain. It will be appreciated that when travelling from entry landing to exit landing, the step chain starts with a longer effective length which shortens in the entry transition zone, remains shortened in the constant slope zone, and then lengthens back to the original effective length in the exit transition zone. This shortening and lengthening of the distance between step axles is what properly positions the steps and keeps them travelling in a constant radius fixed center arcuate path, when viewed in plan.

Figure 10:
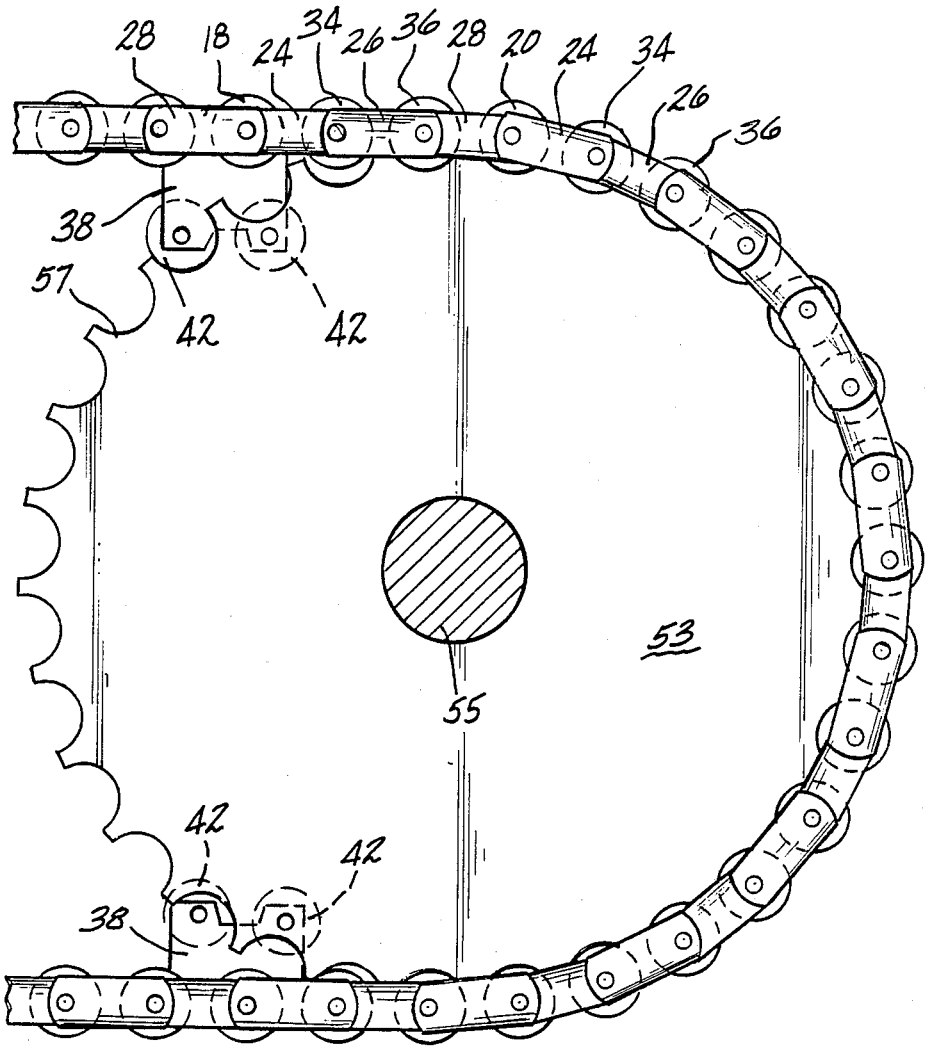
FIG. 10 is an elevational view of the turn around sprocket of the step chain of FIG. 6.

As seen from FIG. 10, when the chain links 24, 26, 28 are all aligned in the horizontal landing zones, they will pass easily over the turn around sprocket 53 at the entry and exit of the escalator. The sprocket 53 is mounted on a driven shaft 55 and is disposed at one of the landing ends of the escalator. It will be appreciated that the escalator is thus of conventional construction wherein the return path of the steps lies beneath the passenger-carrying path. The sprocket 53 is formed with enlarged circumferential recesses 57 which are sized so as to receive and carry the rollers 18, 20, 34 and 36 of the driven step chain. The camming brackets 38 pass behind the sprocket 53 as the chain and steps reverse their path of travel. It will be appreciated that there will be two reversing sprockets, one at each end of the escalator, but only one of which will be a drive sprocket. The other sprocket will be formed as shown but will serve as an idler sprocket which merely guides the chain but does not drive it.

Figure 11:
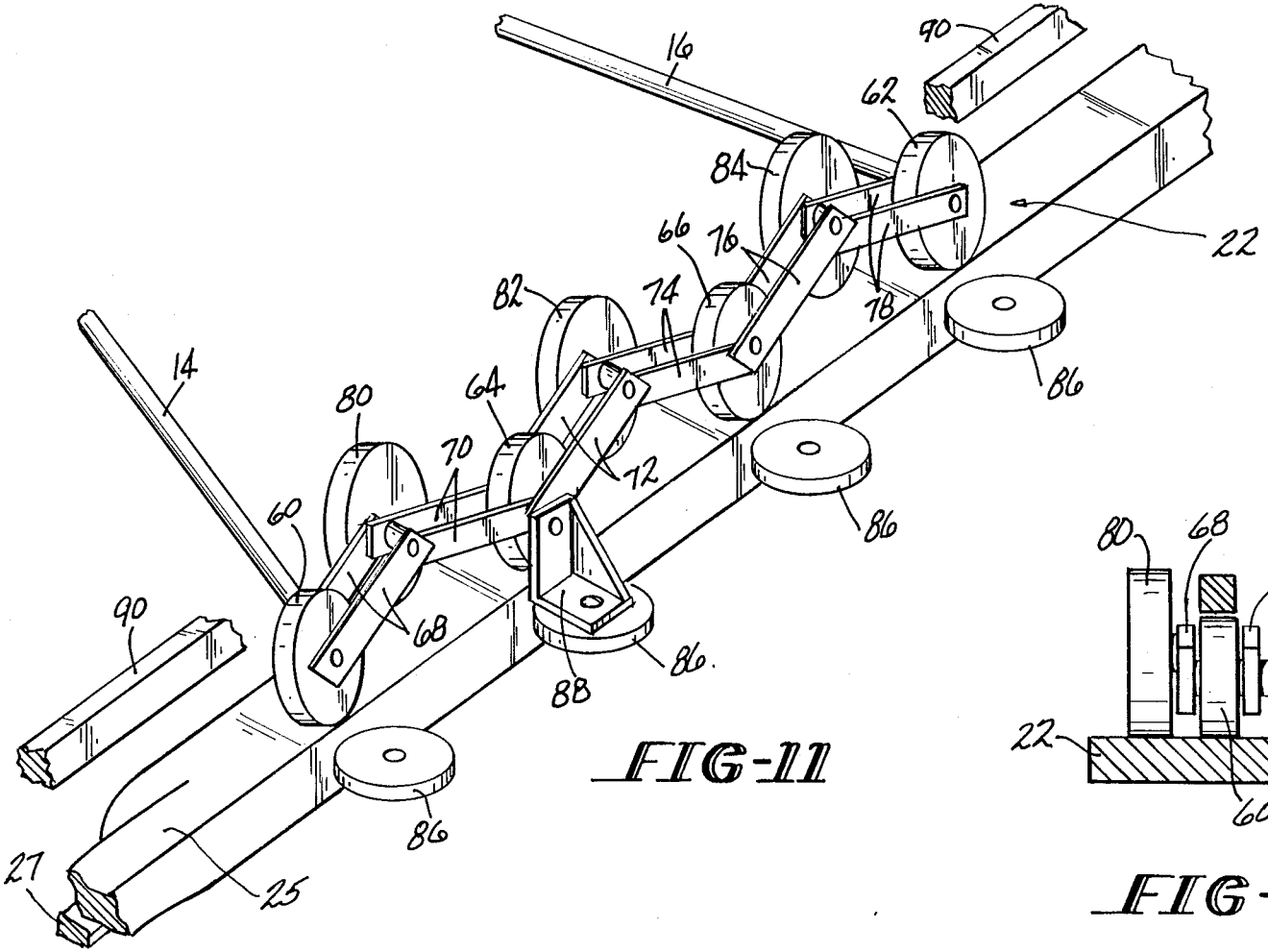
FIG. 11 is a fragmented perspective view of a second embodiment of a step chain and track assembly formed in accordance with this invention and shown in the constant slope intermediate zone of the escalator.
Figure 12:
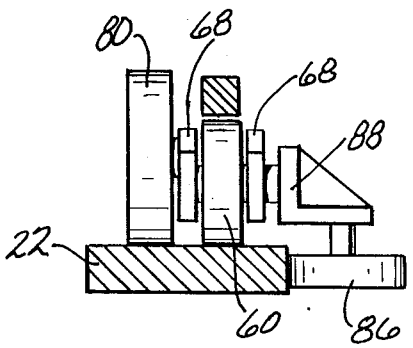
FIG. 12 is a transverse sectional view through the side thrust roller mounts of the assembly of FIG. 10.

Referring now to FIGS. 11–14, there is shown a second embodiment of a step chain assembly formed in accordance with this invention. The track 22 is substantially the same as previously described, and includes an upper branch 25 and a lower branch 27 with transition and landing zones. The step axles 14 and 26 have rotating step axle rollers 60 and 62 respectively which move along a first path on the track 22. There are two additional chain link rollers 64 and 66 mounted at alternating chain link joints between the two axles 14 and 16. The chain has six pairs of pivotally joined links 68, 70, 72, 74, 76 and 78 which combine to connect the step axles 14 and !6 to each other. Three cam rollers 80, 82 and 84 are mounted at intervening chain link joints and travel along a path on the track 22 which is transversely spaced from the chain link and step axle roller path. There are four side thrust rollers 86 mounted on brackets 88 at the step axle and chain roller joints. An upthrust track 90 is mounted above the axle roller and chain link roller path for engagement by the rollers 60, 62 64 and 66 in order to counter upthrust forces which develop in the escalator. FIG. 11 shows the interrelationship between the chain rollers, the side thrust rollers and the upthrust track. It will be noted that the diameter of the cam rollers 80, 82 and 84 is larger than the diameter of the axle rollers 60 and 62, and the chain link rollers 64 and 66. When the step chain section is in the constant slope intermediate zone of the escalator, the track surfaces engaged by the cam rollers 80, 82 and 84, and by the step axle rollers 60 and 62, and chain link rollers 64 and 66 are coplanar, whereby the chain will be kinked as shown in FIG. 11 due to the fact that the centers of the cam rollers are vertically offset from the centers of the rollers 60, 62, 64 and 66.

Figure 13:
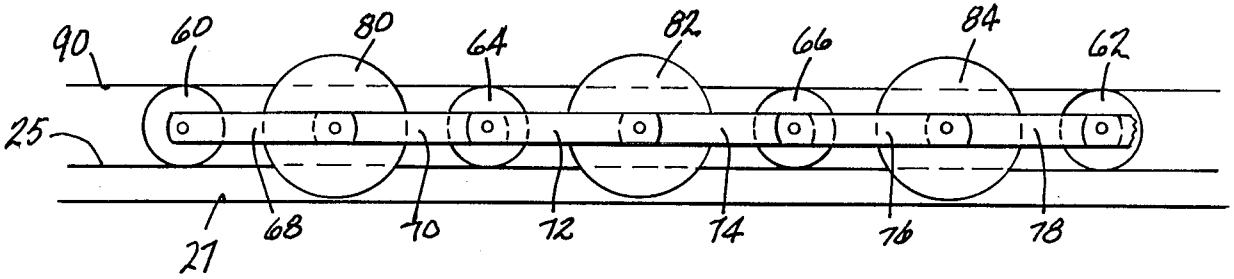
FIG. 13 is a schematic side elevational view of the assembly of FIG. 10 shown in the horizontal landing zones of the escalator.

When the chain enters the exit transition zone of the escalator, the track branches 25 and 27 diverge from each other vertically, until the horizontal exit landing zone is reached, as shown somewhat schematically in FIG. 13. In the horizontal landing zone, the track branch 27 is downwardly offset from the track branch 25 a distance which causes the centers of the rollers 60, 62, 64, 66, 80, 82 and 84 to be aligned, thus straightening out the chain links. Thus, as before, the effective length of the step chain is shorter in the intermediate constant slope, has a variable length in the inclined zone, and is longer in the horizontal landing zones.

Figure 14:
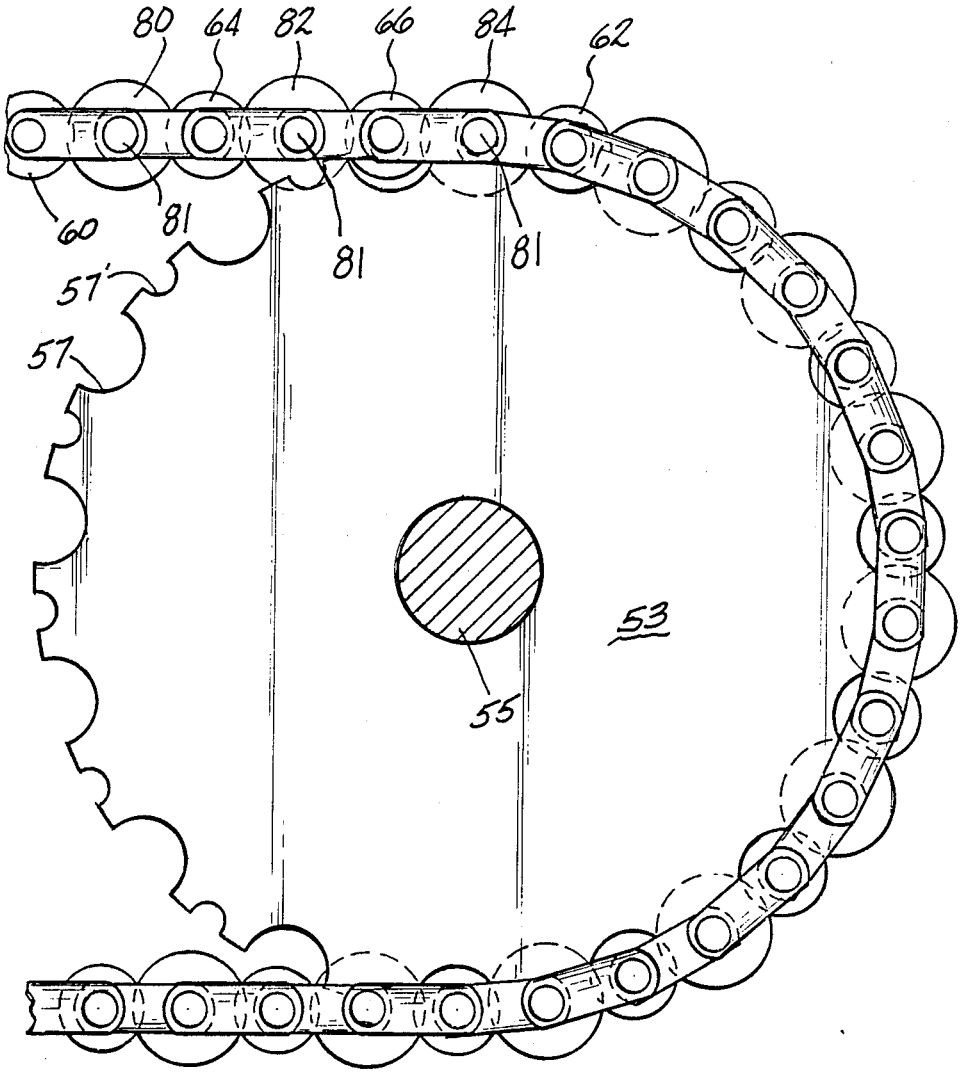
FIG. 14 is an elevational view of the turn around sprocket for the step chain of the second embodiment of the invention.

Referring to FIG. 14, the turn around sprocket 53, which, as above, is mounted on the driven shaft 55, is shown. The circumference of the sprocket 53 is formed with alternating recesses 57 and 57', the former of which engage the rollers 60, 62, 64 and 66, and the latter of which engage the shafts 81 on which the cam rollers 80, 82 and 84 are journaled. As before, the fact that the chain links are coaligned allows the chain and steps to pass easily around the turn around sprockets at each end of the escalator.

It will be readily understood that the step chain and track assembly of this invention allows the escalator path of travel to be defined by a constant radius arc derived from a fixed center point. This in turn allows for greater control of step-to-step, and step-to-skirt gaps in the escalator. Balustrades, tracks and skirts can be more easily formed and accurately installed. Additionally, the step pivoting feature of the invention assures a relatively simple mechanical form which eliminates the complex step connections described in the aforesaid prior art. The movement of the steps is completely controlled at all points in the path of travel of the escalator, and may be customized to accommodate different sweep angles, angles of inclination, and rise distances for the escalator.

It will be appreciated that the adjustments in effective chain lengths must be made in the outer step chain in order to allow the chain and steps to smoothly pass over the turn around sprockets without drastically altering the latter. By using the outer drive chain to change the position of the steps a compact envelope is established for housing the drive assembly for the escalator. The assembly is further simplified by having a single outer step chain roller track in the constant incline portion, and which bifurcates in the landing, and landing transitional zones.

Since many changes and variations of the disclosed embodiments of the invention may be made without departing from the inventive concept, it is not intended to limit the invention otherwise than as required by the appended claims.

I claim:

1. An escalator assembly having an arcuate path of travel defined by a constant radius derived from a fixed center as viewed in plan, the escalator including horizontal entry and exit landing zones, an intermediate constant slope zone, and entry and exit transition zones of constantly varying slope interconnecting the constant slope zone with the entry and exit landing zones respectively, said escalator assembly including:

(a) a plurality of steps, each having a step axle at radially inner and outer sides of the steps; and radially inner and outer step axle rollers rotatably mounted on said step axles;

(b) radially inner and outer step chains forming a flexible continuous connection between said step axles, said step chains controlling the distance between the step axles on adjacent steps;

(c) radially inner and outer tracks providing support for said step axle rollers along the path of travel of the escalator, the outer of said tracks having a first portion thereof comprising vertically offset branches providing two different lines of travel on said outer track when viewed in elevation, one line of which is traversed by said outer step axle rollers and said track branches converging toward each other at said entry transition zone and diverging away from each other at said exit transition zone whereby the angular velocity of the steps changes in said transition zones; and (d) additional rollers on said outer step chain positioned to traverse the other of said two different lines of travel, said additional rollers being operable, when on said other line of travel to change the effective length of said outer chain thereby changing the distance between adjacent step axles so that the steps are properly positioned on the track and on said arcuate path of travel of the escalator.

2. The escalator assembly of claim 1 wherein said outer track further includes a second portion which provides substantially coplanar lines of travel, when viewed in elevation, for said step axle rollers and said additional rollers.

3. The escalator assembly of claim 1 wherein said additional rollers are cam rollers which have a larger diameter than said step axle rollers whereby said cam rollers will form kinks in said outer step chain when on said second portion of said outer track to shorten the distance between adjacent step axles, and said cam rollers will straighten said outer step chain when on said first portion of said outer track to lengthen the distance between adjacent step axles.

4. The escalator assembly of claim 2 wherein said first portion of said outer track is in said landing zones and said second portion of said outer track is in said constant slope zone.

5. The escalator assembly of claim 4 wherein said one step chain comprises a plurality of links serially connected together by pivotal joints, and wherein each alternating joint between said step axle rollers has rotatably mounted thereon a link roller of the same diameter as said step axle rollers and which follows the same path along said outer track as said step axle rollers, and wherein each intervening joint between said alternating joints has mounted thereon one of said cam rollers, said cam rollers being laterally offset on said outer track from said step axle and link rollers.

6. The escalator assembly of claim 5 wherein there are three cam rollers and two link rollers between adjacent step axle rollers.

7. The escalator assembly of claim 6, further comprising an upthrust track disposed above said link and step axle rollers for engagement therewith to provide an upthrust rolling surface for said link and step axle rollers when the step chain is thrust upwardly during movement along the path of travel of the escalator.

8. An escalator assembly having an arcuate path of travel defined by a constant radius derived from a fixed center as viewed in plan, the escalator including horizontal entry and exit landing zones, an intermediate constant slope zone, and entry and exit transition zones of continuously varying slope interconnecting the constant slope zone with the entry and exit landing zones respectively, said escalator assembly including:

(a) radially inner and an outer curved tracks extending between said landing zones for supporting and guiding movement of steps along said path of travel;

(b) a plurality of steps, each having an upper tread portion which remains substantially horizontal throughout a people-transporting portion of the path of travel of the escalator; and a step axle having radially inner and outer ends to which radially inner and outer step axle rollers are journaled, said inner and outer step axle rollers traveling over said inner and outer tracks;

(c) radially inner and outer step chains forming a continuous connection between said step axles whereby all of said steps are connected together at both their radially inner and outer sides throughout the entire path of travel of the escalator, said step chains being formed by a plurality of links serially interconnected together at pivotal joints;

(d) the outer of said step chains being connected to said step axles at spaced apart ones of said chain joints, and said outer step chain having link rollers mounted thereon at alternating chain joints between step axles on adjacent steps of the escalator, said link rollers and said step axle rollers being aligned so as to move along a first line of travel on the outer track associated with said outer step chain, and said outer step chain also having cam rollers mounted thereon at intervening step chain joints between said alternating step chain joints, said cam rollers a larger diameter than said step axle and chain having link rollers and said cam rollers being transversely radially offset on said outer track to move along a second lie of travel on said outer track; and (e) said outer track having a first portion thereof wherein said first and second liens of travel are coplanar as viewed in elevation, and a second portion thereof wherein said first and second lines of travel are vertically offset from each other as viewed in elevation, said first and second portions of said associated track being connected by said transition zones, and said cam rollers being operable when moving on said outer track from one of said track portions to the other to change the effective length of said outer step chain without changing the actual length thereof thereby changing the distance between adjacent step axles so as to properly position the steps on said tracks throughout the path of travel of the escalator.

9. The escalator assembly of claim 8 further comprising an upthrust track disposed above said step axle and chain link rollers to resist upward movement of said step axle, and chain link rollers with respect to said outer track.

10. The escalator assembly of claim 8 wherein said first portion of said outer track corresponds to said constant slope zone of the escalator and said second portion of said outer track corresponds to said landing zones of the escalator, and wherein said cam rollers are operable to shorten the effective length of said outer step chain by forming kinks in the latter in said constant slope zone.

11. The escalator assembly of claim 10 further comprising turn around sprockets at said landing zones for engaging said outer step chain to reverse the direction of movement thereof, and wherein said effective length of the outer step chain is equal to its actual length by reason of all of the outer step chain links being kink-free while passing over said turn around sprockets.

* * * * *